United States Patent [19]

Fiske

[11] 4,354,360

[45] Oct. 19, 1982

[54] AUTOMATIC MACHINE FOR MAKING CRUSHED ICE

[76] Inventor: Herbert E. Fiske, P.O. Box 126, Broomfield, Colo. 80020

[21] Appl. No.: 193,151

[22] Filed: Oct. 2, 1980

[51] Int. Cl.[3] ..... F25C 5/02

[52] U.S. Cl. ..... 62/320; 62/348; 241/DIG. 17

[58] Field of Search ..... 62/320, 348, 352; 241/236, DIG. 17

[56] References Cited

U.S. PATENT DOCUMENTS

| | | | |
|---|---|---|---|
| 181,273 | 8/1876 | Low . | |
| 234,397 | 11/1880 | Field . | |
| 308,760 | 12/1884 | Fairman . | |
| 1,010,062 | 11/1911 | Lyon | 241/236 X |
| 1,048,332 | 12/1912 | Miller . | |
| 2,524,815 | 10/1950 | Leeson . | |
| 2,952,996 | 9/1960 | MacLeod . | |
| 2,962,869 | 12/1960 | Bartels . | |
| 3,037,714 | 6/1962 | Bayston . | |
| 3,913,349 | 10/1975 | Ohling | 62/348 X |
| 4,044,568 | 8/1977 | Hagen . | |
| 4,046,324 | 9/1977 | Chambers | 241/236 X |
| 4,107,943 | 8/1978 | Ohling . | |
| 4,176,527 | 12/1979 | Linstromberg | 62/320 |

FOREIGN PATENT DOCUMENTS

| | | | |
|---|---|---|---|
| 964632 | 3/1975 | Canada | 241/236 |

*Primary Examiner*—William E. Tapolcai
*Attorney, Agent, or Firm*—Wm. Griffith Edwards

[57] ABSTRACT

An ice making and crushing machine includes upright freezing plates for producing sheets of ice and and a pair of oppositely rotating ice breaking members below the plates for receiving the ice upon release by defrosting. The breaking members comprise sets of equally spaced disks each having equally spaced radial arms longitudinally aligned on the members. When rotating the disks form longitudinal pockets which receive and separate the ice in portions and crush it in successive batches. Substantially the entire area of the freezing plates is exposed to water on one side and refrigerant on the other for speeding the production of ice and the refrigerant circulating system affords equal cooling and the forming of ice of the same thickness on both plates.

21 Claims, 11 Drawing Figures

AUTOMATIC MACHINE FOR MAKING CRUSHED ICE

This invention relates to machines for making crushed ice, and particularly to an improved apparatus for freezing ice in sheets and for releasing the ice and crushing it to a predetermined range of sizes.

BACKGROUND OF THE INVENTION AND PRIOR ART

In the latter part of the past century, machines or devices were provided for the purpose of chipping or shaving ice from blocks of ice supplied to the machine for that purpose. Some of those devices included arrangements of cutters mounted on parallel shafts which were rotated in opposite directions. By way of example, such devices are illustrated in U.S. Pat. No. 181,273 Low, issued Aug. 22, 1876, U.S. Pat. No. 234,397 Field, issued Nov. 16, 1880, U.S. Pat. No. 308,760 Fairman issued Dec. 2, 1884, and U.S. Pat. No. 1,048,332 Miller issued Dec. 24, 1912. When artificial refrigeration had been developed for portable units it became a practice to freeze ice in selected sizes and shapes and various combined freezing and molding or shaping devices were provided for this purpose. These machines included freezers which formed a sheet of ice and were heated periodically to release the ice and supply it to breaking rollers or chippers which chipped or crushed the ice into particles. The breaking mechanism included devices such as a pair of shafts which were rotated in opposite directions and carried pins or cutters for engagement with blocks or sheets of ice which were thereby crushed or broken. By way of example, ice making and crushing machines of this general type are illustrated in U.S. Pat. No. 2,524,815 Leeson issued on Oct. 10, 1950 and U.S. Pat. No. 2,962,869 Bartels issued on Dec. 6, 1960.

The crushed ice producing machines known heretofore have been used, for example, in restaurants and motels to provide a continuing supply of crushed ice and have been satisfactory for many such applications. It is desirable to provide an ice crushing machine of greater reliability over long periods of time and capable of producing a consistently uniform output of crushed ice within a selected range of sizes. Accordingly, it is an object of this invention to provide an ice crushing apparatus including an improved mechanism for effecting the production of crushed ice within a predetermining range of sizes of the pieces.

It is another object of this invention to provide a crushed ice making machine including an improved form and arrangement of ice breaking elements.

It is a further object of this invention to provide a crushed ice making machine including an improved arrangement for releasing ice from the freezing surfaces and for preventing the delivery of water to the accumulated crushed ice.

SUMMARY OF THE INVENTION

Briefly, in carrying out the objects of this invention, a machine for making crushed ice is provided which includes a means for forming upright sheets of ice, employing heat to release the ice, which then falls onto an ice breaking mechinism to be reduced to pieces of the desired range of sizes. The ice breaking mechanism includes two elongated ice breaking members mounted on parallel axes and arranged to be rotated toward one another on their upper sides. Each member comprises a shaft having a multiplicity of disc-like breaking elements secured in equally spaced positions along the shaft. The elements on one shaft are staggered with respect to those on the other shaft, and the shaft axes are spaced a distance substantially less than the diameter of the elements so that the elements are interleaved as they pass the shafts. Each element has a plurality of equally spaced radial arms, say four, and the shafts are arranged so that the arms all move and meet in opposite sets in the plane of the axes of the shafts. The sets of arms opposite each other on the upper side of the breakers form an open slot which receives a portion of ice and on moving toward each other the arms on the elements break the portion of ice from the ice above it and the ice is crushed by the elements as it passes between the shafts. Continued rotation carries the portions of ice downwardly where it is further broken and the members then open to release the ice which falls to a collecting bin. A plurality of slots are formed during each revolution of the members and successive portions are delivered to the bin until the ice has all passed through the breaker. Any excess of water delivered to the freezing plates is kept from reaching the ice bin. The control of the apparatus is arranged to assure uniform formation of ice on the two freezing plates and to assure that the ice delivered to the breaker is dry. An ice level sensor is mounted in the ice bin and when the bin is full signals the control to shut down the apparatus.

The features of novelty which characterize this invention are pointed out with particularity in the claims annexed to and forming a part of this specification. The invention itself, however, both as to its organization, and its manner of operation, together with further objects and advantages thereof, will best be understood upon reference to the following description taken in connection with the accompanying drawings.

DESCRIPTION OF PREFERRED EMBODIMENT

Figure 1:
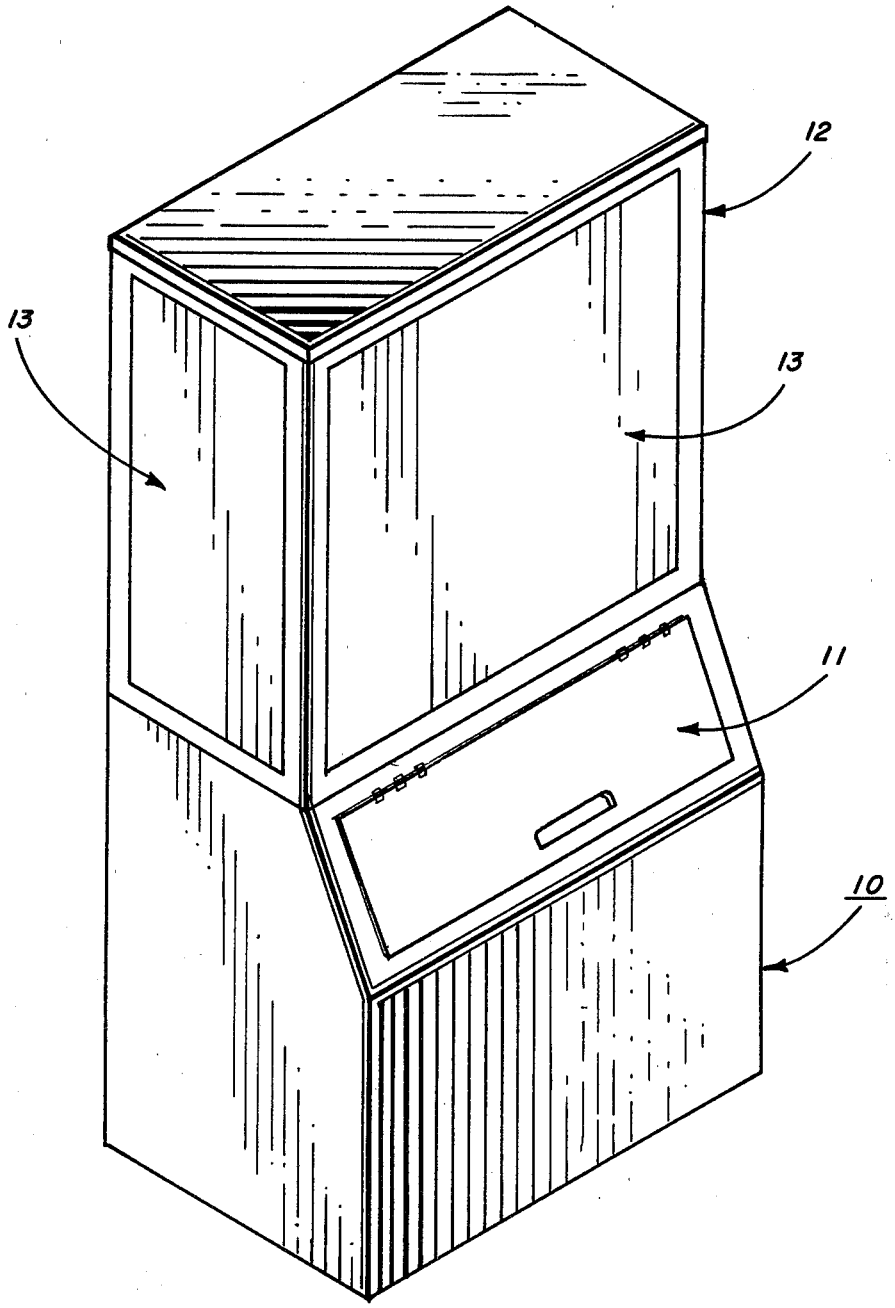
FIG. 1 is an isometric view of a housing suitable for the ice making machine of this invention.

Referring now to the drawings; FIG. 1 illustrates the housing arrangement for a crushed ice making apparatus embodying the invention. The housing comprises a lower base portion 10 which is the ice collecting bin, and has a door 11 for providing convenient access to the stored ice. A top housing portion 12 contains the freezing unit that is mounted on the top of the housing 10 over an opening therein whereby the crushed ice is delivered to the ice bin as it is made.

The housing 12 is provided with detachable panels 13 on all four sides for providing access to the ice making and crushing apparatus of the refrigerating machine.

Figure 2:
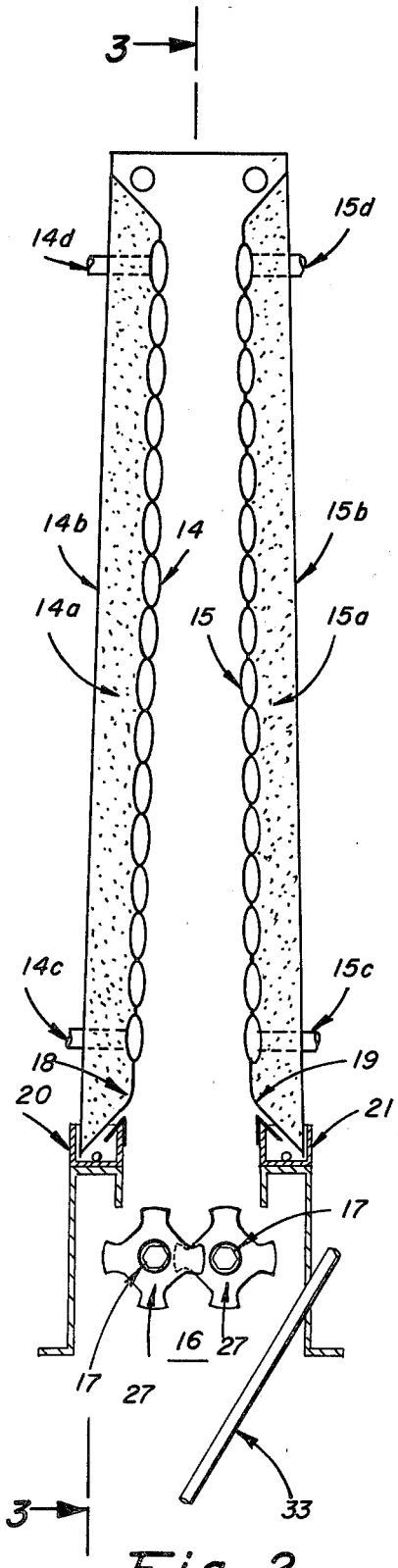
FIG. 2 is a sectional elevation view of an ice crushing apparatus embodying the invention.
Figure 3:
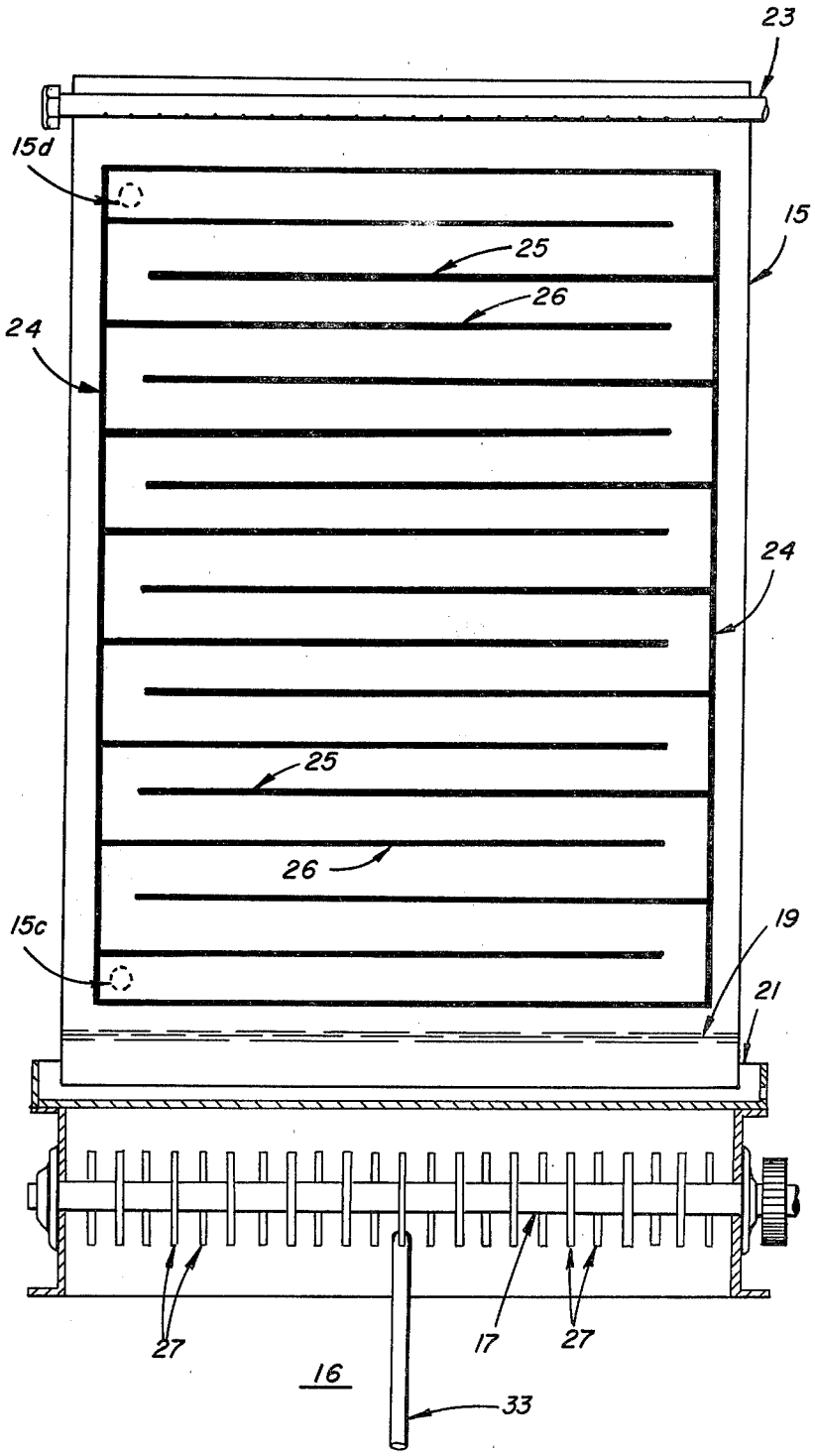
FIG. 3 is a sectional view on the line 3—3 of FIG. 2.

FIGS. 2 and 3 show the arrangement of the ice making and ice crushing devices of the machine, such that sheets of ice are formed and released so that they drop onto the crushing mechanism. Two upright freezing plates 14 and 15 are mounted in spaced upright positions directly over a pair of ice breaking members 16 which are mounted on parallel shafts 17 and are driven by respective meshing gears 17*a* to rotate in opposite directions at the same speed so that the upper portions of the members 16 move toward one another. The freezing plates 14 and 15 diverge or slope somewhat away from one another toward the lower end which minimizes the likelihood that ice may jam and be retained between the plates. The bottom ends of plates 14 and 15 are turned outwardly as indicated at 18 and 19, respectively, so that the bottom edges terminate directly over respective drain troughs 20 and 21. The bottom ends 19 are formed as bends in the plates 14 and 15, but in each case are smooth and rounded. The purpose of these bends is to make sure that any water flowing down over the plates will move outwardly at the bottom ends and into the troughs 20 and 21 and will not drop into the ice bin. It has been found that a bend on a one-half inch radius with the straight sides at an angle of 50° is very effective for directing the water away from the ice product and is the preferable configuration of the bend. Water to be frozen is delivered to the tops of the plates from water headers 22 and 23 which have small holes directed toward the top inner surfaces of the plates 14 and 15. Water is supplied to the plates so that it flows easily onto the plates and does not splash.

The freezing plates 14 and 15 are of the same construction, each being formed from a pair of stainless steel sheets welded along narrow lines to provide a peripheral sealing weld 24 extending around the edge of the plate and passage forming welds 25 and 26 extending alternately from the right and left sides of the peripheral weld 24 thereby forming a zigzag passage through the freezing plate which passage covers substantially the entire surface area of the plate with the exception of the narrow welded portions. The plates are made by welding them as first indicated and then expanding the sheet placing them in a rigid form and between the welds by fluid pressure to form a conduit of wide shallow configuration. The outer wall faces of the passage, which are smooth with no sharp turns or edges, present an undulating configuration in their cross section. In order to prevent condensation of moisture on the back side of the freezing plates and to minimize the absorption of heat the back of the plate is covered with a heavy layer of insulation such as expanded synthetic material, the insulation being indicated at 14*a* and 15*a* on the respective plates. Stainless steel sheets indicated at 14*b* and 15*b* enclose the insulation so that the freezing plate assemblies are complete enclosed units. The passages in the plates formed as described are arranged so that the refrigerant flows from inlets 14*c* and 15*c* at the bottoms of the plates and upwardly back and forth across the plates in horizontal paths to the outlets 14*d* and 15*d* at the tops. The ice frozen on the plates forms over the undulations and increases in thickness as the water flows over the plates.

When the ice is to be released the breaking mechanism 16 is started and warm liquid is supplied to the refrigerant passage and the two sheets of ice are released. The undulations formed by the refrigerant tubes tend to cam the released sheets of ice away from the freezing plate; this facilitates a quick and complete release of the ice sheet upon defrosting.

The sheets of ice are cold and brittle and during heating and release may break into a number of pieces; the released sheets or pieces then drop and collect against the rotating breaking mechanism.

Each of the ice breaking members 16 comprises a multiplicity of disc-like ice breaking elements 27 spaced equally along the respective shaft 17. All of these elements are of the same size and configuration and have a plurality of radial arms, there being four such arms in the illustrated embodiment. All the arms on each member 16 are mounted in axial alignment. The elements 27 are mounted on their respective shafts 17 in staggered relationship with the elements on the other shaft, and the shafts are mounted with their axes spaced from one another by a distance substantially less than the diameter of the breaking elements 27 so that the elements are interleaved in the zone between the shafts, as in FIG. 4.

The foregoing arrangement of the members 16 and their aligned sets of cutting elements rotates the sets of radial arms so that two sets at the top of the member 16 approach each other as the members rotate and form an upwardly open elongated alot along the tops of the members. Ice falls into this slot and as the sets of arms approach each other the outer corners of the arms engage and break the ice so that an elongated portion of ice is trapped by the arms and moves downwardly with the arms between the members 16. This breaks the ice into small pieces which are discharged toward the collecting bin as the arms move downwardly and away from each other forming a downwardly open slot from which the ice falls into the bin. Thus the operation of the rotating elements effects the chopping off of an elongated batch or portion of the ice each time a pair of arms approaches and moves downwardly through the space between the members. The effect of the operation of the machine is thus to produce crushed ice in successive small portions at a rate determined by the speed of the members 16 and the number of arms on the cutting elements.

Figure 6:
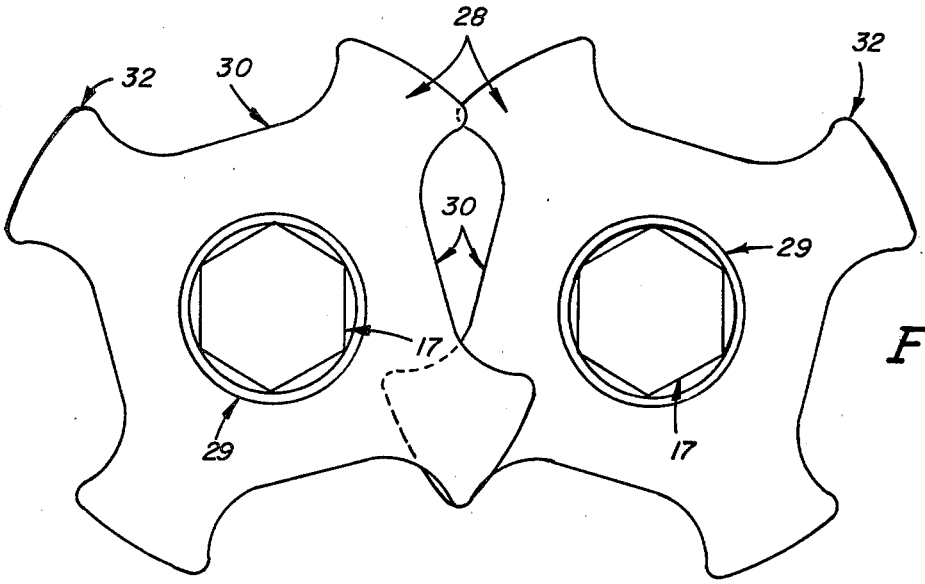
FIGS. 6 and 7 are views illustrating different positions of the ice breaking elements.
Figure 7:
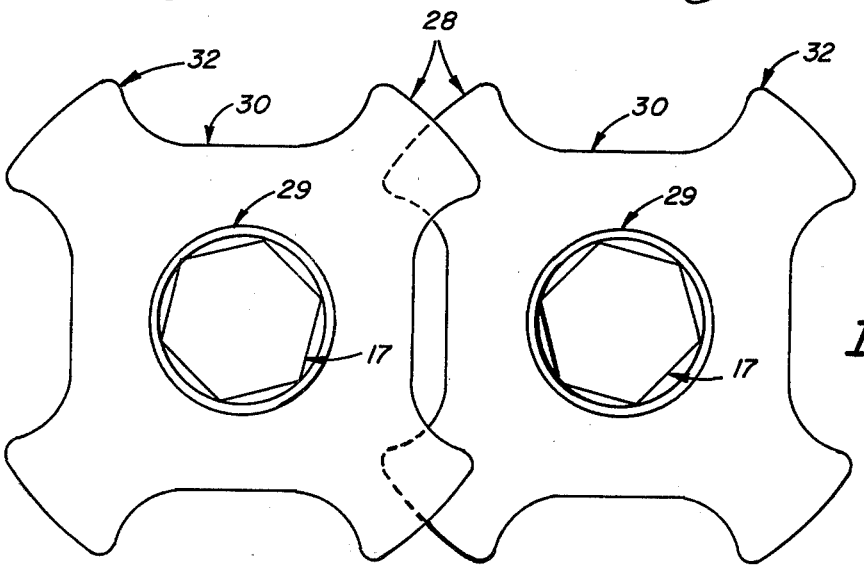
Figure 5:
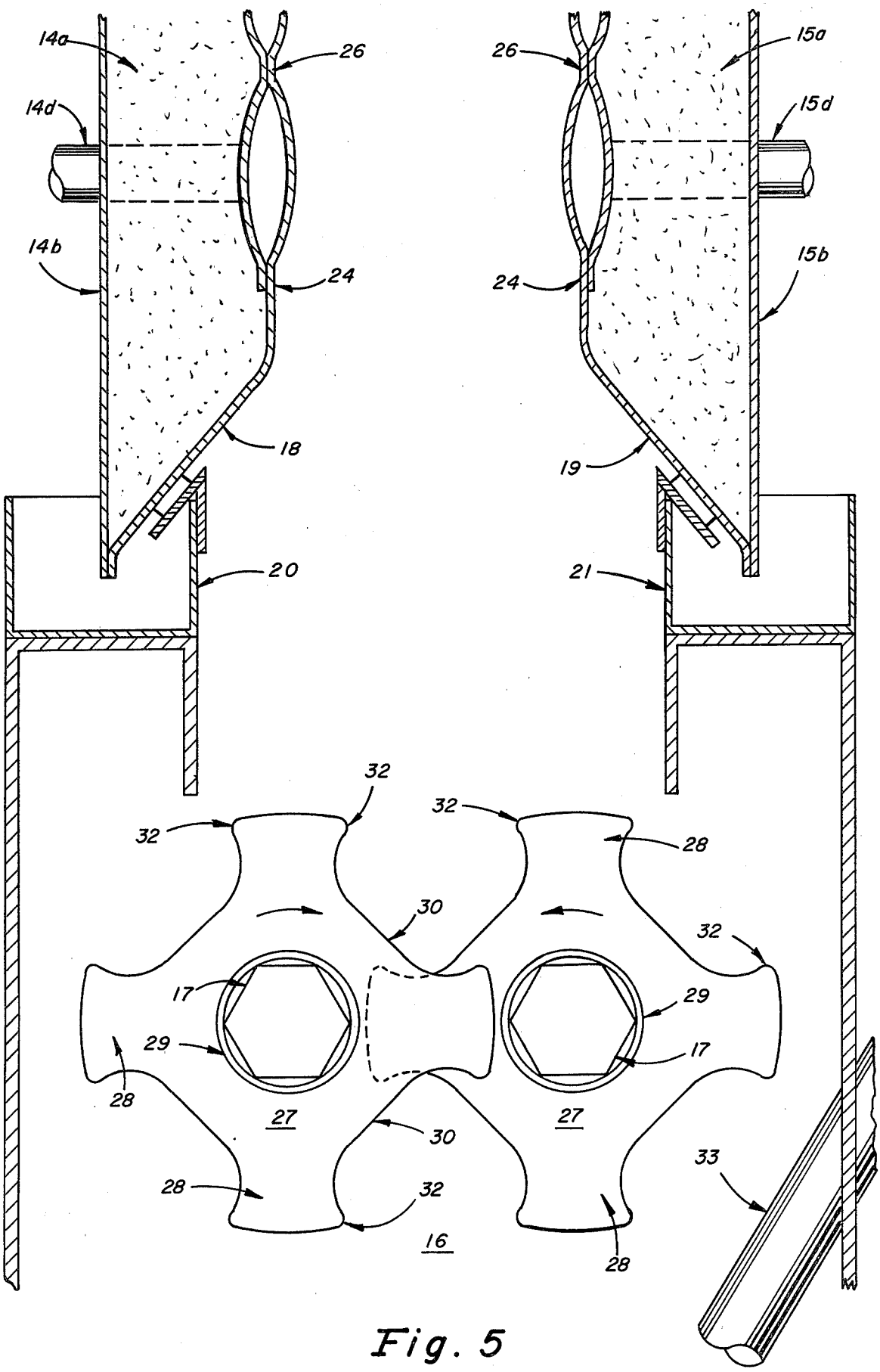
FIG. 5 is an enlarged end elevation view of the lower portion of the apparatus as shown in FIG. 2.
Figure 8:
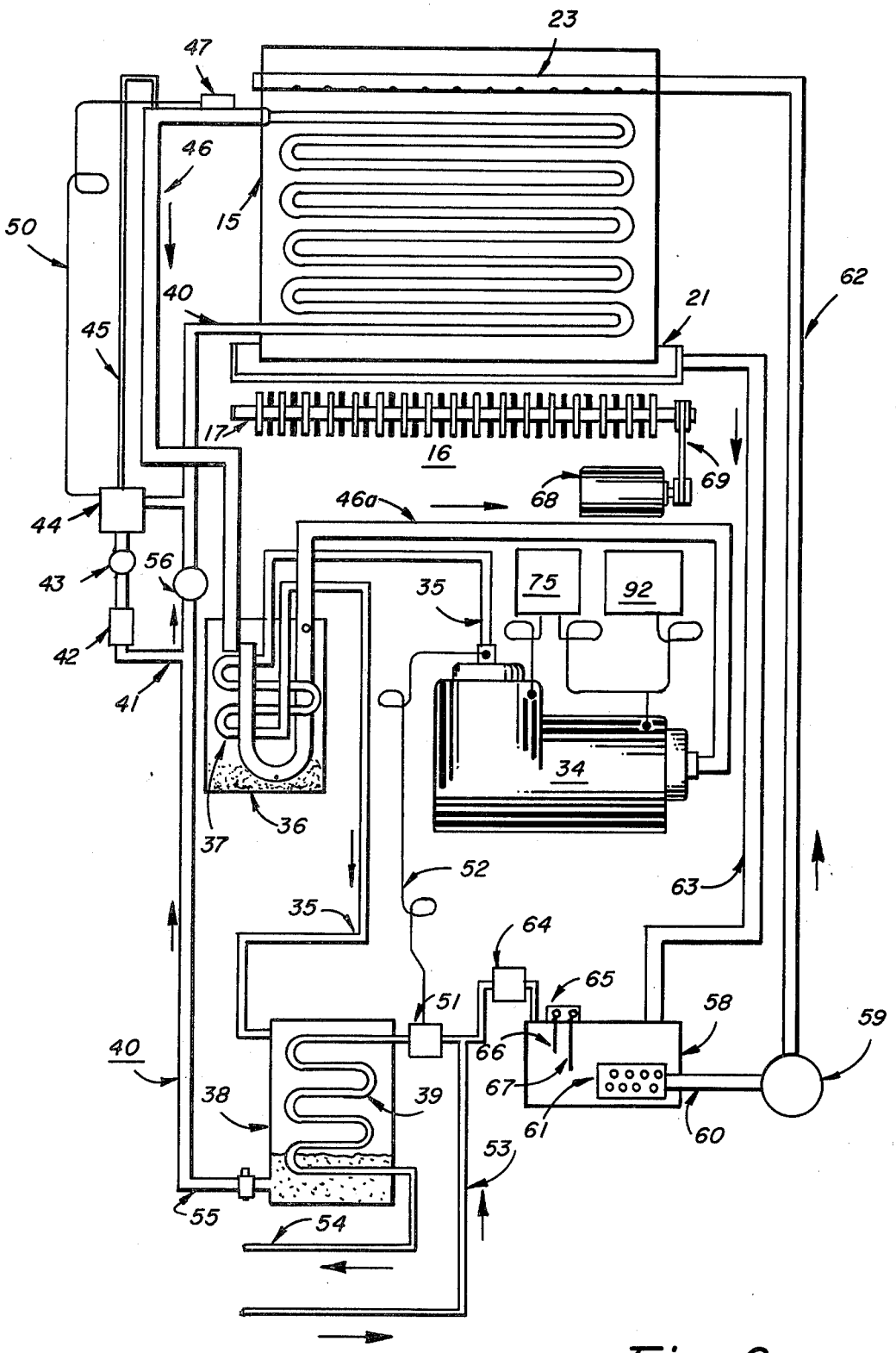
FIG. 8 is a diagrammatic illustration of the refrigerant circuit of the apparatus.

The configuration of the ice cutting elements and the manner in which the ice breaking members 16 operate will be more readily understood from the enlarged views of the elements as shown in FIGS. 5, 6 and 7. In FIG. 5 the element 27 is shown mounted on the shaft with the top and bottom ones of the four arms 28 on the vertical axis and the other pair of the four arms of each element aligned along the horizontal axis. The shafts 17 have been illustrated as hexagonal and the elements 27 have hexagonal openings which fit closely but slidably on the shafts while preventing relative rotation of the shafts and elements. The elements 27 are spaced from one another by cylindrical sleeves 29 which fit closely about the hexagonal shaft and provide a cylindrical enclosure for the shaft.

During the assembly of the members 16 the sets of arms are placed on the shaft with the spacers 29 between adjacent elements, the element 27 at one end being welded or otherwise secured rigidly to the shaft and the remaining elements being stacked against the one element with the sleeves 29 acting as spacers. All of the elements are held tightly together while the other end element is welded or otherwise suitably secured to the shaft. This provides a compact and rigid structure, the elements 27 being prevented from rotating with respect to the shaft and the sleeves 29 enclosing the shaft. As indicated by the arrows, the shafts are rotated in opposite directions so that the arms 28 at the top move toward one another during rotation of the shafts. In the position of FIG. 5 the space between the aligned arms 28 at the top constitutes an open slot into which pieces of ice or the edges of sheets of ice fall by gravity and are held by the elements 27. The peripheries of the arms 28 are arcuate and have been illustrated as circular about the center of rotation of the elements. The configuration of the elements 27 may be considered generally square with the arms 28 formed at the corners. This configuration is formed by the elongated spaces between adjacent arms 28, these spaces having an essentially flat edge 30 which extends between the two arms 28 and has concave arcuate portions 31 at each end. The arcuate portions 31 meet the arcuate outer ends of the arms and form wedge-like corners 32 with the edge portions 30 which provide a generally square appearance at the main body of the element. The edges 30 preferably are formed to lie normal to the central radial axis of the element 27 which is intermediate to the arms 28.

The arms have a radial length slightly less than the width of the space between the shafts, the radial width of the portions of the members intermediate the arms being less than one-half the distance between the shafts so that, when the intermediate portions are between the shafts, an axially extending space is provided between the sets of members. By way of illustration should a sheet of ice fall and lie within the slot formed between the two arms 28, the arms will continue to approach the sheet and the corners 32 will reach the position shown in FIG. 6 where they have met after locking on the ice and breaking it along the line of the arms. After the initial breaking of the ice, the elements 27 continue to rotate until they reach the position of FIG. 7 where they have been shown at an angle of about 45° from the position in FIG. 5. In this position the members 16 form a relatively level resting area for the ice on top of the breaking mechanism. Thereafter the members move to the position of FIG. 5. When the elements 27 have again reached the position of FIG. 5 the portion of ice originally trapped in the upper slot will have fallen from the space between the elements and continued rotation will repeat the trapping of ice in the upper slot and its movement down through the elements to break it into pieces. The size of the pieces of ice produced by this crushing mechanism is dependent upon the spacing of the elements 27 and the size and number of the arms 28.

When the elements are in a position shown in FIG. 7 the upper area of the ice breaking member presents a relatively flat surface along the members 16 and the ice released from the freezing plates may cover this area. In this location of the elements 27 the arms 28 will sweep the upper compartment and carry the trapped portion of ice downwardly. It will be noted from the position of the arms in FIG. 5 that the ends of these arms which are interleaved and overlapping lie close to the sleeves 29 so that the arms sweep the zone between the elements 27 and the ice is swept out and carried downwardly.

The concave curved sides of the arms 28 forming the wedge-like corners 32 facilitate the gripping and holding of the ice as the corners come together during rotation of the elements. The crushing elements 27 are preferably made of stainless steel and may, for example, be 3⅝ inches in outer diameter and have a thickness of 3/16ths inch. This provides strong ice-breaking members which may operate continuously for long periods of time without injury or extensive wear. The stainless steel of the plates and also of the spacers 29 makes the ice-breaking members easy to clean and avoids difficulties which might arise because of corrosion were the discs made of other materials. The structural features of the discs and their rotation with the arms in alignment provides a positive crushing and displacement of the crushed ice downwardly into the bin in separate batches or portions separated successively from the ice resting on the breaking mechanism.

During normal operation the starting and stopping of the machine is controlled by a probe 33 positioned at the desired level of the ice when the bin is full. The probe is sensitive to changes of temperature resulting from the contact of the ice with the lower end of the probe housing. The probe is housed in a rigid tube of sufficient strength to prevent damage should it be struck by a shovel or other implement.

The refrigerating system is of the compression type and is operated continuously in successive freezing and harvesting cycles until the system is shut down by operation in response to a signal from the sensor 33. The freezing cycle is operated by a timer, the length of the cycle determining the thickness of the sheets of ice which are formed. At the end of each freezing cycle the compressor continues to run briefly so that the ice on the plates is dried and hardened before the defrosting fluid is supplied to the evaporator. The harvesting cycle is of short duration, say three minutes, and when it terminates the water is again delivered to the plates as the freezing cycle begins. This operation with successive freezing and harvesting cycles continues until the sensor 33 signals that the bin is full whereupon one more harvesting cycle is completed to make sure that no ice is left above the breaking mechanism and the machine then stopped.

Figure 4:
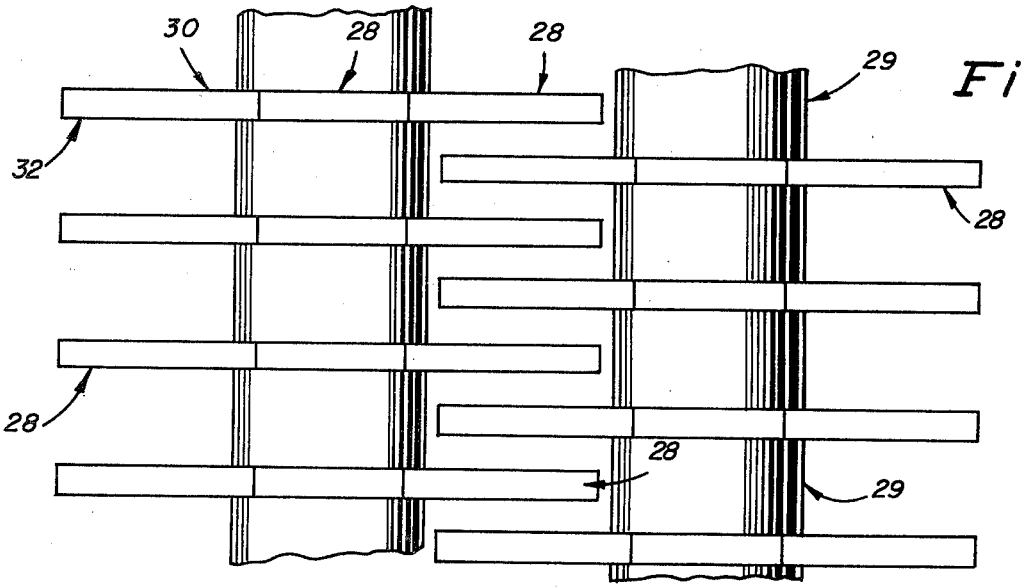
FIG. 4 is a plan view of a portion of the apparatus.

The refrigeration system employed for cooling the freezing plates is of the well-known compression type. This system is illustrated diagrammatically, and FIG. 4 illustrates the arrangement of the various components of the system in the refrigerant circuit and the location of the fluid controls. One of the freezing plates is shown diagrammatically at 15, the refrigerated passage being illustrated as a single zigzag tube. The gaseous refrigerant is compressed by operation of a motor compressor unit 34 which delivers hot compressed gas through the discharge conduit 35 of the compressor which conduit passes through an accumulator 36 in heat exchange relationship with the low pressure refrigerant therein. The accumulator is connected in series in the suction line 46 between the evaporator outlet and the compressor intake and is made of a size sufficient to hold the entire charge of liquid refrigerant. This holding capacity prevents the return of liquid refrigerant to the compressor and is a safety feature. For heat exchange purposes, the compressor discharge line 35 is formed to provide an extended coil 37 within the accumulator so that some of the heat of the compressed gas is removed while the gas is flowing through the coil. After passing through the accumulator 36 the line 35 delivers the gaseous refrigerant to a condenser-receiver 38 where it is cooled and liquefied by water flowing through a coil 39, the liquid collecting in the condenser. The liquid refrigerant is discharged from the condenser through a line 40 which, during the cooling cycle, supplies liquid to the evaporator through a line 41, a dryer 42, a sight glass 43 and the thermostatic expansion valve 44. The thermostatic expansion valve is of the externally equalized type, having an equalizer tube 45 connected to the discharge conduit or suction line 46 of the evaporator.

The thermostatic valve has a sensor 47 responsive to the temperature of the gas at the outlet of the evaporator, the sensor being connected to the valve through a fluid line 50. The cooling of the condenser 38 is controlled by a water supply valve 51 which is responsive to the pressure of the gas discharged from the compressor, the pressure responsive sensor being connected to the control valve through a fluid line 52. Valve 51 controls the flow of water from a suitable supply through a pipe 53, water flowing through the coil 39 and then being discharged through a line 54. A master or king valve 55 is connected in the line 40 to shut off the flow of liquid from the condenser when desired. This valve is open during the normal operation of the system.

During the operation of the system when the level of crushed ice falls in the bin the motor-compressor unit 34 is started in response to the signal from the sensor 33. When the compressor unit 34 is in operation, compressed gaseous refrigerant is discharged through the conduit 35, passes through the coil 37 in the accumulator 36, and is delivered to the condenser-receiver 38. The liquid refrigerant flows through the thermostatic expansion valve 44 as described above because the direct path through conduit 40 is closed by a normally closed solenoid valve 56 which is the defrost control valve. When the freezing plate is cooled, the gas evaporated in the plate is delivered through the conduit 46 to the accumulator 36 and thence returned to the compressor through its inlet conduit, indicated at **46*a*, and which is thus an extension of the conduit 46. When the defrosting cycle is called for, the valve 56 is opened and liquid refrigerant passes directly through the line 40 by-passing the thermostatic expansion valve. After heating the freezing plate the liquid flows through the line 46 to the accumulator where it is trapped, the intake for the suction line 46*a*** is at the top of the accumulator above the level of liquid. Thus liquid is prevented from reaching the compressor intake.

The thickness of the sheet of ice to be frozen is determined by operation of a timing control. By way of example, the freezing period may be about twenty minutes. Water to be frozen is supplied to the water header 23 from a tank or reservoir 58 by operation of a pump 59. The pump inlet is connected to the tank by a pipe 60 which is fitted with a strainer 61 at its inlet within the tank. The pump delivers water to the header 23 through a supply pipe 62 and excess water is returned to the tank from the trough 21 through a conduit 63. Makeup water is supplied to the tank 58 from the line 53 by operation of a solenoid valve 64, actuated by a water level control 65. The control 65 has water level probes 66 and 67 within the tank and which are set at the high level and low level positions, respectively. The valve 64 is opened and will be supplying water to the tank 58. When the water level has reached the probe 66 the valve 64 will close until the level again drops below the probe 67.

The ice breaking members 16 are driven by a gearmotor 68 through a chain 69. After the freezing period when the ice is ready for defrosting the electrical controls described below operate to shut off the water pumps 59 to open the valve 56 and to start the motor 68. Opening of the valve 56 bypasses the thermostatic valve 44 and delivers hot liquid refrigerant from the condenser 38 directly through the line 40 to the zigzag passage of the freezing plate. The sheet of ice is thus released and falls onto the breaker members 16 where it is crushed and delivered to the ice collecting bin 10 below. The freezing and harvesting operation continue until the probe 33 signals that the bin is full.

Figure 9:
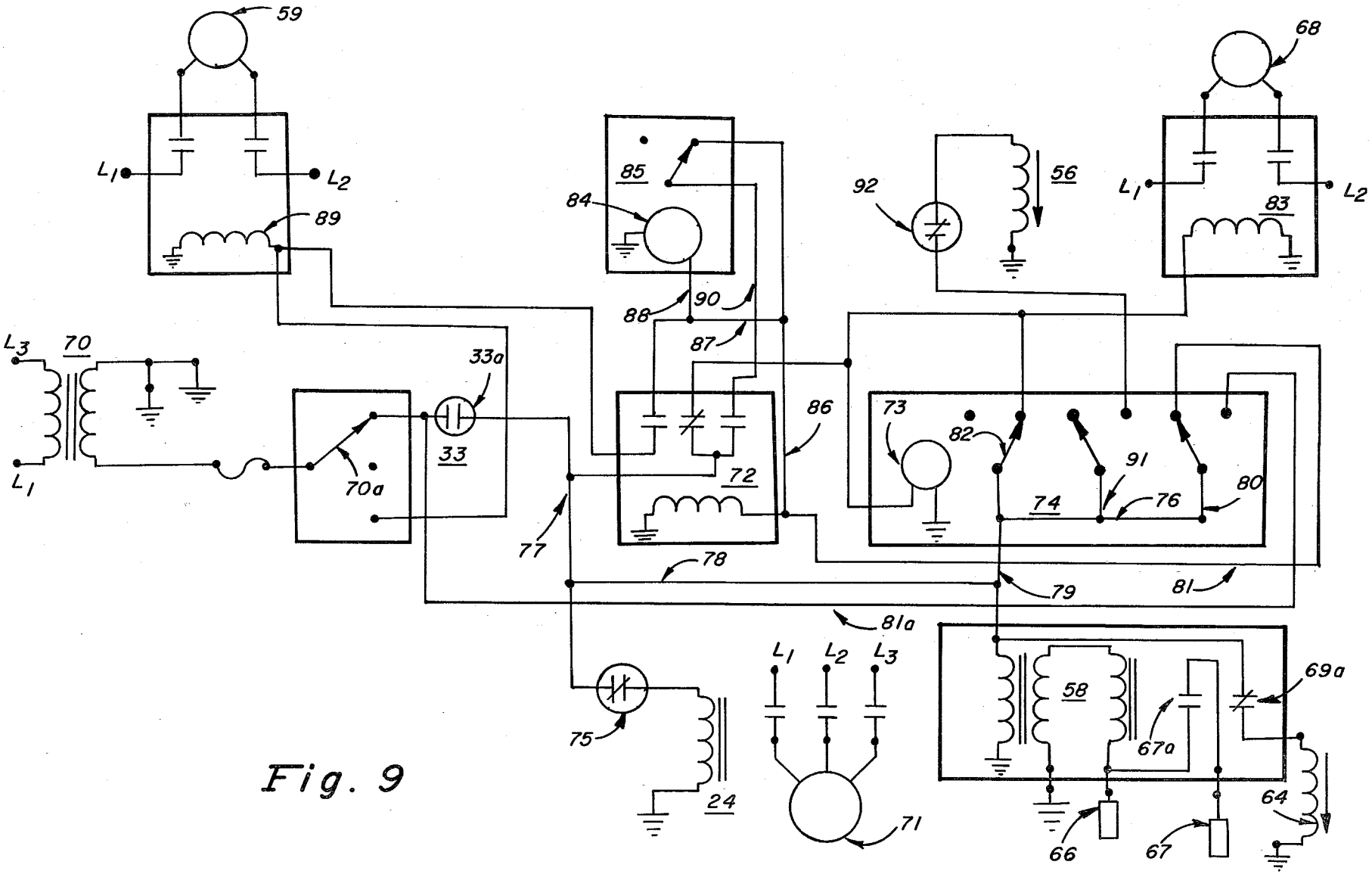
FIG. 9 is a diagrammatic illustration of the electrical circuits of the apparatus.

The various functions of the refrigerating and ice harvesting system as described above are accomplished under control of the electrical circuit and its components schematically illustrated in FIG. 9. In this figure the switches except the main switch and those of the timers are indicated as spaced parallel lines which are normally open unless crossed by a diagonal line in which case they are normally closed. In this figure the system is shown in it standby condition with the ice bin level control 33 satisfied. Power is supplied from lines L1 and L3 to a transformer 70 and through a main switch **70*a* to the circuit and is on, the water supply 53 is turned on, and the level control probe contacts are open, the water level being below the bottom of the lower probe 67. When the bin level control 33 calls for ice, a coil 24*a* is energized and the three contactors of the compressor motor 71 are closed and connect the motor to three-phase A.C. power supply lines L1, L2 and L3; power is also supplied to the water level control 58, to a holding relay 72, to the gearmotor relay 83 and to a motor 73 which drives the harvesting control timer indicated at 74. The timer 74 includes three microswitches actuated by cams (not shown) on a common shaft driven by the motor 73; the switches are actuated by arms or cam followers which engage the cams. The cams are adjustable to select the actuating time and sequence of operation of the switches. The high-low pressure switch, indicated at 75, being closed, the compressor starts, and the cooling operation begins. The water level is below the lower probe 67 and the solenoid 64 is energized and calling for water. A line 76 which is common to the three microswitches of the timer 74 is connected to the power line through the now closed probe switch 33*a* by lines 77, 78 and 79, and the holding relay 72 is energized through the right hand switch 80 of the timer in its left hand position and a line 81. This opens the second or center switch of the holding relay and closes the first and third switches. The left hand switch 82 of the timer 74 being closed energizes the relay 83 of the gearmotor 68 to connect that motor to power lines L1 and L2 and also energizes the motor 73 to drive the timer 74. The right hand switch 80 of the timer 74 in its left hand position also energizes a motor 84 of an automatic reset timer 85 through lines 81, 86, 87 and 88. The timer 85** controls the freezing time of the operating cycle.

When the holding relay 72 is energized the left hand contact is closed; this energizes a relay 89 which starts the water pump 59. The right hand contact is also closed and provides a holding circuit through a line 90 and the line 86 for the holding relay 72. About five seconds after the motor 73 starts right hand microswitch 80 is moved to its right hand contact and closes a circuit from the line 76 to the input side of the bin control switch **33*a* through a line 81*a* so that the holding circuit for the relay 72 will keep the system running through a complete freezing-harvesting cycle whether or not the switch 33*a* remains closed. This arrangement of the controls will not allow a shutdown except after the end of the harvesting cycle. A further feature of this control is that even after a momentary power failure the holding relay will drop out and the controls will cause the system to go into the harvest cycle as soon as power is restored, the motors 68 and 73 being energized through the normally closed middle switch of the relay 72. The timer motor 73 will run for about five seconds after the microswitch 80 has closed on its right hand contact, and at this time switch 82 will open and deenergize both motors 68 and 73. This is the beginning of the freezing cycle which may be set for any time, for example, between five and thirty minutes. At the end of the freezing cycle the switch on reset timer 85 opens, the holding relay 72 drops out and the motors 68 and 73 are energized through the center contacts of the relay to start the harvesting cycle. The opening of the right hand switch of the holding relay stops the pump motor 59 and the reset timer motor 84. The closing of the center switch of the holding relay starts the timer motor 73 and the gearmotor 68**. The compressor continues to run and with the water turned off the ice on the plate will begin to dry out and harden slightly.

In say, five seconds, the cam will move to its right hand position as shown on the drawing and the motors 68 and 73 will run for the full harvest cycle. In about five more seconds the middle microswitch indicated at 91 will close and energize the solenoid 56 to initiate defrosting, by delivering hot liquid refrigerant from the condenser through the line 40 directly to the bottom of the evaporator passage. The solenoid will be energized for say 135 seconds and the ice will be released and drop onto the crusher at some time between 20 and 90 seconds after the solenoid opens. The solenoid valve 56 will close when the switch 91 opens and the refrigerant cycle will begin again, the refrigerant flowing again through the thermostatic expansion valve. After say 45 seconds, the switch 80 will return to its left hand position, and if the bin level sensor is closed and calling for ice the timer motor 73 will continue to run and the freezing cycle will continue. If the ice level sensing control is satisfied the system will shut down until ice is again needed.

A low presssure safety control 92 is connected in the circuit of the solenoid 56 and controls the solenoid to maintain the evaporation pressure in the range of say, 80 to 110 pounds per square inch during the harvest cycle.

The sensor 33 is within its tube or protecting sheath and there is a time delay between contact with the ice and the cooling of the sensor and one additional harvesting cycle will be completed before shut down.

Figure 10:
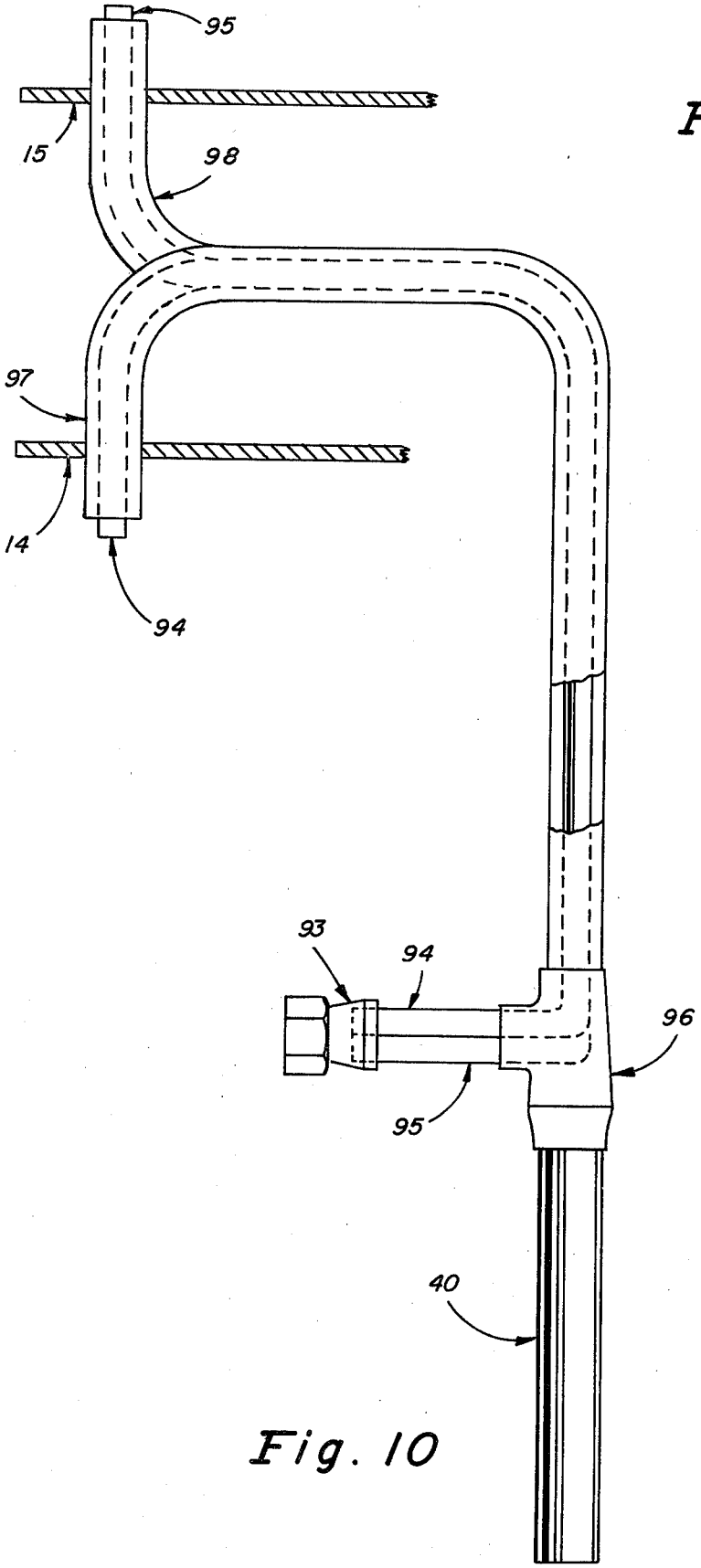
FIGS. 10 and 11 are plan and side elevation views of a refrigerant distributor of the invention.
Figure 11:
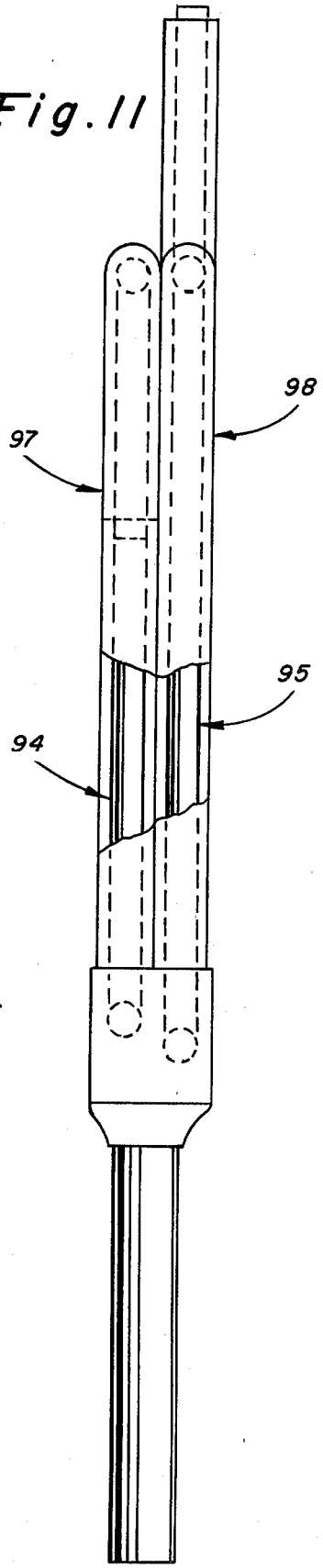

When two evaporators are employed as in FIGS. 2 and 3 is it important that the sheets of ice when harvested be of substantially the same thickness. This assures that the crushed ice product will have the full range of sizes of the pieces. It is desired to minimize any tendency toward non-uniform refrigeration of the two evaporators or the starving of one evaporator when both are fed from the same expansion valve. The refrigerant supply fitting or arrangement illustrated in FIGS. 10 and 11 has been found effective for this purpose. This figure illustrates the refrigerant line connection between the thermostatic expansion valve and the inlets of the two evaporators.

A two-way distributor 93 is provided for connection to the output of the thermostatic valve. The two outlets of the fitting are connected to two relatively small diameter tubes 94 and 95. A distributor 96 is provided on the hot liquid supply line 40 and two tubes 97 and 98 are secured in this fitting and constitute branches of the line 40 which are connected to the inlets of the evaporator plates 14 and 15, respectively.

The valve outlet lines 94 and 95 enter the fitting 96 and extend through the tubes 97 and 98, respectively, and deliver refrigerant to the evaporators 14 and 15. The tubes reduce the effective cross section of the branches 97 and 98 and offer resistance to the flow of refrigerant. It will be observed that the branch tubes connect the two evaporators so that they are in communication through the two-way distributor 96. Similarly, the tubes 94 and 95 connect the evaporators through the fitting 93. However, any tendency of refrigerant to flow from one evaporator to the other through the branches or through the tubes is resisted and minimized by the long paths through the tubes 93 and 94 and the branches 97 and 98. This effectively prevents uneven distribution of refrigerant to the evaporators.

The operation of the ice making and crushing machine as described produces crushed ice the pieces of which are uniformly within the range determined by the spacing and configuration of the rotating breaking elements 27. This uniformity of size range resulting from the configuration and spacing of the ice breaking elements produces uniform and consistent results during the continuous operation of the machine.

While this invention has been described as applied to a specific cabinet mounted apparatus other applications and modifications will be apparent to those skilled in the art. Therefore it is not desired that the invention be limited to the particular arrangements illustrated and described, and it is intended by the appended claims to cover all modifications within the spirit and scope of the invention.

I claim:

1. In an ice crushing machine of the type comprising a generally upright freezing surface, means for cooling said surface, and means for distributing water over said surface to be frozen thereby forming a layer of ice thereon, an ice breaking mechanism positioned below said surface and comprising a pair of shafts mounted for rotation in opposite directions on spaced generally parallel axes, each of said shafts having a plurality of spaced ice breaking disk-like members arranged in a set along the shaft, the improvement wherein the members of the set on each shaft are interleaved with the members of the set on the other shaft, each of said members having radial arms thereon spaced equally about the axis of the shaft, said arms having a radial length slightly less than the width of the space between the shafts, the radial width of the portions of said members intermediate said arms being less than one half the distance between the shafts whereby when said intermediate portions are between the shafts an axially extending space is provided between said sets of members, means for rotating said shafts at the same rate to move said arms on one shaft toward those on the other shaft on the upper side of said shafts, the forward radially extending edges of said arms on each of said shafts being in axial alignment and being positioned with respect to the adjacent arms of the members on the other shaft to form an upwardly open slot axially of the members during each revolution as the respective arms approach each other during rotation of said shafts, means for heating said surface to release a layer of ice therefrom whereby the released ice falls against said members and upon formation of said slot and further rotation of the members the portion of ice in the slot is broken away and separated from the remaining released ice and is broken into pieces of a predetermined range of sizes by interaction of the interleaved members and on continued rotation of the members is moved downwardly and falls from said ice breaking mechanism, the interleaved portions of said sets of members after separation of the portion of ice holding the remaining ice above said members whereby said ice remains against the members while the next slot is formed and filled and another portion of the ice is then broken away, such breaking continuing to produce successive portions of ice during rotation of said shafts until all the released ice has been broken.

2. The invention of claim 1 wherein said members are disk-like plates mounted concentrically about the respective shaft and spaced from and parallel to one another, each of said members having the same number of equally spaced radial arms, the members of one set being staggered with respect to those on the other and the distance between the axes of said shafts being substantially less than the diameter of said plates whereby said members on the side of one shaft which is adjacent the other shaft are interleaved with those on the other, said arms being positioned so that each arm of a member on one shaft is in alignment with an adjacent overlapping arm on the other shaft when in the plane of the axes of said shafts and said arms overlap for a major portion of their lengths.

3. The invention of claim 1 or claim 2 wherein the outer ends of said arms are arcuate and of substantial width and lie in a common circle about the axis of rotation of said members.

4. The invention of claim 1 or claim 2 wherein said surface is essentially flat and including a second similar cooling surface spaced from said first mentioned surface and forming an upright column therewith whereby two layers of ice are formed in said column and on defrosting fall against said members.

5. The invention of claim 4 wherein the spaces between said members are the same on both shafts and the members are of the same size and configuration whereby the range of sizes of the pieces of ice in the successive portions are substantially the same.

6. The invention of claim 4 wherein at least one of said surfaces slopes downwardly and outwardly from the vertical to provide a wider lower opening for preventing the jamming and accumulation of released ice between the surfaces.

7. The invention of claim 4 wherein the surfaces are the faces of substantially flat plates and the bottom portion of each plate is bent outwardly away from the plane of the freezing surface whereby water running down the upright face of the plate will move outwardly along the surface of said bottom portion and drop from the bottom edge thereof whereby the water is conducted away from the broken ice path, a water catching trough extending below to the outer edge of said bottom portion, and means for draining water from said trough.

8. The invention of claim 7 wherein the bend between said plate and its bottom portion is smooth and rounded and of sufficient radius that the water flows smoothly around it and does not drop off.

9. The invention of claim 8 wherein the angle of the bent portion with respect to the plane of the plate is about 50°.

10. The invention of claim 1 or claim 2 wherein the leading edge of each of said arms extends radially outwardly in a concave arc forming a wedge-like corner with the outer end of the arm, said corners during operation of the mechanism cooperating with corresponding corners of the interleaved members on the other shaft to sieze and lock the ice and break the ice during rotation of the members after each trough forming position has been reached.

11. The invention of claim 10 wherein the trailing edge of each arm extends radially outwardly in a concave arc.

12. The invention of claim 10 wherein the peripheral edge of each member between adjacent arms forms an elongated space extending substantially normal to the central radius between said adjacent arms whereby during rotation of said sets of members an axially extending chamber is formed between the sets upon meeting and overlapping of said arms and containing the portion of ice broken by said cooperating corners, said chamber being closed by the immediately preceding set of arms and being opened to release the contained portion of broken ice upon further rotation of the members.

13. The invention of claim 12 wherein each of said members has four equally spaced arms.

14. The invention of claim 12 or claim 13 wherein the peripheral edge of each member between said arms is substantially straight and lies normal to said central radius.

15. The invention of claim 10 wherein the periphery of each said member between said pair of said arms is substantially straight.

16. The invention of claim 1 or claim 2 wherein said freezing surface is the surface of an essentially flat freezing plate and each freezing plate of said machine is of sheet metal formed to provide closely spaced parallel horizontal conduits of relatively flat slightly bulging cross section for conducting cooling fluid in heat transfer relationship with substantially the entire area of the plate whereby said cooling plate has a substantially smooth freezing surface with an undulating vertical cross section.

17. The invention of claim 16 wherein said conduits are connected at their ends by turns of substantially the same cross section as the horizontal conduits to form a continuous passage from the inlet to the outlet of said plate.

18. In an ice crushing machine of the type comprising a generally upright freezing surface, means for cooling said surface, and means for distributing water over said surface to be frozen thereby forming a layer of ice thereon, an ice breaking mechanism positioned below said surface and comprising a pair of shafts mounted for rotation in opposite directions on spaced generally parallel axes, each of said shafts having a plurality of spaced ice breaking members arranged in a set along the shaft, the improvement wherein the members of the set on each shaft are interleaved with the members of the set on the other shaft, each of said members having radial arms thereon spaced equally about the axis of the shaft, means for rotating said shafts at the same rate to move said arms on one shaft toward those on the other shaft on the upper side of said shafts, the forward radially extending edges of said arms on each of said shafts being in axial alignment and being positioned with respect to the adjacent arms of the members on the other shaft to form an upwardly common suction line adjacent said evaporators for supplying liquid refrigerant to said evaporators, and means for delivering equal amounts of refrigerant to both said evaporators for producing the same thickness of ice thereon, said delivering means including a first two-way fluid distributor adjacent the outlet of said thermostatic expansion valve and two long relatively small diameter tubes connecting said distributor and respective ones of the intakes of said evaporators whereby said evaporators are in open communication through said tubes and said first distributor, a conduit for delivering hot refrigerant from said condenser to said evaporators, a second two-way fluid distributor and respective branch conduits connected thereto for delivering hot liquid refrigerant to the respective ones of said evaporators for defrosting said evaporators whereby said evaporators are in open communication through said branch conduits and said second distributor, the lengths of the paths of said open communication between said evaporators being sufficiently great to effectively prevent the passage of refrigerant through said paths from one evaporator to the other.

19. The invention of claim 18 wherein said members are disk-like plates mounted concentrically about the respective shaft and spaced from and parallel to one another, each of said members having the same number of equally spaced radial arms, the members of one set being staggered with respect to those on the other and the distance between the axes of said shafts being substantially less than the diameter of said plates whereby said members on the side of one shaft which is adjacent the other shaft are interleaved with those on the other, said arms being positioned so that each arm of a member on one shaft is in alignment with an adjacent overlapping arm on the other shaft when in the plane of the axes of said shafts and said arms overlap for a major portion of their lengths.

20. The invention of claim 18 or claim 19 wherein said small tubes enter said second distributor and pass through respective ones of said branch conduits to the respective ones of said evaporators, whereby the effective cross section of said branch conduits is reduced.

21. In an ice crushing machine of the type comprising a generally upright freezing surface, means for cooling said surface, and means for distributing water over said surface to be frozen thereby forming a layer of ice thereon, an ice breaking mechanism positioned below said surface and comprising a pair of shafts mounted for rotation in opposite directions on spaced generally parallel axes, each of said shafts having a plurality of spaced ice breaking members arranged in a set along the shaft, the improvement wherein the members of the set on each shaft are interleaved with the members of the set on the other shaft, each of said members having radial arms thereon spaced equally about the axis of the shaft, means for rotating said shafts at the same rate to move said arms on one shaft toward those on the other shaft on the upper side of said shafts, the forward radially extending edges of said arms on each of said shafts being in axial alignment and being positioned with respect to the adjacent arms of the members on the other shaft to form an upwardly open slot axially of the members during each revolution as the respective arms approach each other during rotation of said shafts, means for heating said surface to release a layer of ice therefrom whereby the released ice falls against said members and upon formation of said slot and further rotation of the members the portion of ice in the slot is broken away and separated from the remaining released ice and is broken into pieces of a predetermined range of sizes by interaction of the interleaved members and on continued rotation of the members is moved downwardly and falls from said ice breaking mechanism, the interleaved portions of said sets of members after separation of the portion of ice holding the remaining ice above said members whereby said ice remains against the members while the next slot is filled and another portion of the ice is broken away, such breaking continuing in successive portions during rotation of said shafts until all the released ice has been broken, said machine further including means for controlling the operation of said machine in accordance with the accumulation of ice below said breaking mechanism, said means including a probe for detecting the accumulation of crushed ice to a predetermined level, said probe including a temperature sensor and a protective sheath positioned in the path of accumulating crushed ice, said probe providing a substantial delay between contact with ice and response of said sensor whereby termination of operation of the machine is delayed for a predetermined interval of time after accumulated ice contacts said probe.

* * * * *

UNITED STATES PATENT AND TRADEMARK OFFICE

CERTIFICATE OF CORRECTION

PATENT NO. : 4,354,360

DATED : October 19, 1982

INVENTOR(S) : Herbert E. Fiske

It is certified that error appears in the above-identified patent and that said Letters Patent are hereby corrected as shown below:

Column 12, line 14, cancel "or claim 13"

Add the following claim:

--22. The invention of claim 13 wherein the peripheral edge of each member between said arms is substantially straight and lies normal to said central radius.--

Column 12, line 55, after "upwardly" insert the following:

--open slot axially of the members during each revolution as the respective arms approach each other during rotation of said shafts, means for heating said surface to release a layer of ice therefrom whereby the released ice falls against said members and upon formation of said slot and further rotation of the members the portion of ice in the slot is broken away and separated from the remaining released ice and is broken into pieces of a predetermined range of sizes by interaction of the interleaved members and on continued rotation of the members is moved downwardly and falls from said ice breaking mechanism, the interleaved portions of said sets of members after separation of the portion of ice holding the remaining ice above said members whereby said ice remains against the members while the next slot is filled and another portion of the ice is broken away, such breaking continuing in successive portions during rotation of said shafts until all the released ice has been broken, wherein said surface is essentially flat and including a second similar cooling surface spaced from said first mentioned surface and forming an upright column therewith whereby two layers of ice are formed in said column and on defrosting fall against said members, the cooling of the freezing plates being effected by a compression type refrigerating

UNITED STATES PATENT AND TRADEMARK OFFICE

CERTIFICATE OF CORRECTION

PATENT NO. : 4,354,360

DATED : October 19, 1982

INVENTOR(S) : Herbert E. Fiske

It is certified that error appears in the above-identified patent and that said Letters Patent are hereby corrected as shown below:

apparatus having two evaporators one associated with each of said plates, a common suction line for said evaporators, a condenser and means including a liquid refrigerant supply line and a thermostatic expansion valve responsive to the temperature of refrigerant in said--

Signed and Sealed this

*Nineteenth* Day of *March 1985*

[SEAL]

*Attest:*

DONALD J. QUIGG

*Attesting Officer* *Acting Commissioner of Patents and Trademarks*